US010655844B2

(12) United States Patent
Adams et al.

(10) Patent No.: US 10,655,844 B2
(45) Date of Patent: May 19, 2020

(54) PEDESTAL FOR A BURNER OF A HOUSEHOLD APPLIANCE

(75) Inventors: David Adams, Norris, TN (US); Ben Braden, Lafollette, TN (US); Russell Dorsten, Knoxville, TN (US); Jonathan Grey, Huntersville, NC (US); Donald Hendricks, Caryville, TN (US); Chris Hill, Knoxville, TN (US); David Nowak, Powell, TN (US); Tim Russell, Jacksboro, TN (US); Graham Sadtler, New Bern, NC (US); Phil Springer, Knoxville, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 1653 days.

(21) Appl. No.: 12/368,493

(22) Filed: Feb. 10, 2009

(65) Prior Publication Data

US 2010/0199968 A1 Aug. 12, 2010

(51) Int. Cl.
*F23D 14/62* (2006.01)
*F23D 14/06* (2006.01)

(52) U.S. Cl.
CPC .... *F23D 14/06* (2013.01); *F23D 2900/14042* (2013.01); *F23D 2900/14064* (2013.01)

(58) Field of Classification Search
USPC ..... 126/39 R, 39 E; 431/266, 284, 286, 354, 431/129
See application file for complete search history.

(56) References Cited

U.S. PATENT DOCUMENTS 1,030,118 A * 6/1912 O'Neil ..... F24C 3/126 126/52
2,023,624 A * 12/1935 Tullis ..... F23D 11/44 239/555
2,344,144 A * 3/1944 Hobson ..... 126/39 R
4,810,188 A 3/1989 Kwiatek
4,891,006 A * 1/1990 Le Monnier de Gouville ..... F23D 14/06 431/349
5,046,477 A * 9/1991 Bennett ..... F24C 15/107 126/214 A
5,080,580 A * 1/1992 Clapp ..... F23D 11/443 126/39 R
5,098,283 A * 3/1992 Clapp ..... F23D 11/443 126/39 G
5,291,875 A * 3/1994 Koziol ..... 126/41 R
(Continued)

FOREIGN PATENT DOCUMENTS

EP 0581655 A1 2/1994

*Primary Examiner* — Vivek K Shirsat
(74) *Attorney, Agent, or Firm* — Michael E. Tschupp; Andre Pallapies; Brandon G. Braun

(57) ABSTRACT

A gas burner of a household cooking appliance is provided. The gas burner includes a burner portion, and a pedestal portion under the burner portion for elevating the burner portion above a cooktop surface of the household cooking appliance. The pedestal portion includes a base portion for mounting with the cooktop surface of the household cooking appliance, and an upper portion that interposes the base portion and the burner portion, and interfaces with the burner portion. A perimeter of the base portion has no mathematical correlation to one of a perimeter of the burner portion and a perimeter of the upper portion.

63 Claims, 20 Drawing Sheets

(56) References Cited

U.S. PATENT DOCUMENTS

| | | | | |
|---|---|---|---|---|
| 6,067,978 | A * | 5/2000 | Schlosser | F23D 14/06 126/39 E |
| 6,135,764 | A * | 10/2000 | Kwiatek | F23D 14/06 126/39 E |
| 6,299,436 | B1 * | 10/2001 | Huang | 431/354 |
| 6,315,552 | B1 * | 11/2001 | Haynes et al. | 431/285 |
| 6,318,993 | B1 * | 11/2001 | Huang | 431/354 |
| 6,322,354 | B1 | 11/2001 | Carbone et al. | |
| 6,328,556 | B1 * | 12/2001 | Somer | 431/266 |
| 6,439,881 | B2 * | 8/2002 | Haynes et al. | 431/354 |
| 6,439,882 | B2 * | 8/2002 | Haynes et al. | 431/354 |
| 6,736,631 | B2 * | 5/2004 | Ferlin et al. | 431/266 |
| 7,291,009 | B2 | 11/2007 | Kamal et al. | |
| 7,322,820 | B2 | 1/2008 | Welton et al. | |
| 7,871,264 | B2 * | 1/2011 | Pryor et al. | 431/354 |
| 8,511,294 | B2 * | 8/2013 | Paesani | F23D 14/06 126/39 E |
| 2002/0039713 | A1 * | 4/2002 | Dane | F23D 14/06 431/354 |
| 2003/0024525 | A1 | 2/2003 | Jennings | |
| 2003/0087214 | A1 | 5/2003 | Welton et al. | |
| 2003/0140918 | A1 * | 7/2003 | Taplan | F24C 3/085 126/39 R |
| 2006/0000467 | A1 * | 1/2006 | Hibshman et al. | 126/39 E |
| 2006/0051718 | A1 * | 3/2006 | Kamal et al. | 431/354 |
| 2008/0160468 | A1 * | 7/2008 | Pryor et al. | 431/286 |
| 2009/0047611 | A1 * | 2/2009 | Armanni | 431/284 |
| 2009/0100837 | A1 * | 4/2009 | Von Der Bank | F23R 3/32 60/737 |
| 2009/0320823 | A1 * | 12/2009 | Padgett | 126/39 E |

* cited by examiner

PEDESTAL FOR A BURNER OF A HOUSEHOLD APPLIANCE

FIELD OF DISCLOSURE

The present invention relates to a household appliance, and more particularly, to a household cooking appliance having a gas burner, and more particularly, to a pedestal for a gas burner of a household appliance.

BACKGROUND

In conventional cooking appliances, one or more burners are disposed on a cooktop surface of the cooking appliance. For example, FIG. 1 shows a conventional household cooking appliance 10 having a housing 12 and a cooktop surface 14. The cooktop surface 14 includes a plurality of burners 20. The housing 12 supports a grate 26 to support a cooking utensil, such as a pot, pan or kettle over the burner 20. The cooktop surface 14 has a plurality of openings (not shown) defining the positions for each of the burners 20. The cooktop surface 14 shown in FIG. 1 has a sealed burner arrangement.

Although burners for controlling gas flow and flame generation in a cooking appliance have been known, a recent development improves flame spreading features within a controlled area so that the burner does not create a limited set of rings of heat application to a cooking utensil. For example, U.S. application Ser. No. 08/955,002 discloses a multiple fingered burner that expands the heating zone without exposing the peripheral ports in the fingers to exposure from spills occurring above the cooktop. The multiple fingered burner increases or maximizes a perimeter of the burner while also providing more consistent heating of a cooking utensil across the heating zone. That is, the multiple fingered burner expands the heating zone to be more consistent over the perimeter and central zones of the cooking utensil.

While such an arrangement improves distribution of the flames within a cooktop area, recent developments have attempted to further improve access to primary and secondary air in order to maintain appropriately sized flame kernels throughout the irregular pattern of flame kernels throughout the cooktop area, and particularly when a sealed burner arrangement is provided.

Additionally, recent cooktop innovations have attempted to maintain a low profile burner so as not to expose a protruding, interfering surface above the cooktop surface of the appliance. However, the lowering of the burner in the cooktop also may interfere with the free flow of secondary air near the burner ports that receive and discharge a primary fuel and air mixture. In addition, the conventional cooktop designs that provide sealed burner openings may restrict access to secondary air within the appliance and prevent the use of this air as secondary bypass air near the burner ports.

Some conventional appliances attempt to improve access to secondary air for flame production while also minimizing the height of the burner with respect to the cooktop surface. Referring to FIGS. 2A-2D, in some conventional appliances, the cooktop surface 14 includes a "volcano-type" pedestal 30 that is integrally formed with the cooktop surface 14 to elevate the burner 20 above the cooktop surface 14. The burner 20 may be a circular or oval burner, a multiple fingered burner, or other burner. This arrangement may improve access to secondary air for flame production. The integral "volcano-type" pedestal 30 commonly is stamped or formed in the material of the cooktop surface 14 of the appliance. The "volcano-type" pedestal 30 commonly mimics the shape of the burner 20 to provide support for the burner 20. Also, the size of the "volcano-type" pedestal 30 commonly is greater than or equal to the size of the burner 20.

In other conventional systems, the burner may include a pedestal, either separate or integral, to elevate the burner above the cooktop surface. Conventionally, the pedestal has a shape that corresponds to, or mimics, the shape of the burner. Also, the size of the pedestal is greater than or equal to the size of the burner to provide support for all areas of the burner.

SUMMARY

The present invention recognizes that there is a need to provide an appliance having a burner that improves access to secondary air for flame production while also minimizing the height of the burner with respect to the cooktop surface.

Conventional "volcano-type" pedestals may be integrally formed with the cooktop surface to elevate the burner above the cooktop surface to improve access to secondary air for flame production. However, these conventional pedestals also increase the footprint of the pedestal and burner. As shown in FIGS. 2A-2D, the increased size of the footprint of the "volcano-type" pedestal 30 results in an increase in the length of the interface 32 between the cooktop surface 14 and the "volcano-type" pedestal 30. This interface 32 may increase the susceptibility of the appliance to trapping or capturing food or spills and also may increase the time and difficulty of cleaning around the burner 20, and more particularly, cleaning the interface 32 between the "volcano-type" pedestal 30 and the cooktop surface 14. The length of the interface 34 between the burner 20 and the "volcano-type" pedestal 30 also may increase the time and difficulty of cleaning around the burner 20, and more particularly, cleaning the interface 34 between the burner 20 and the "volcano-type" pedestal 30.

Furthermore, the conventional pedestals commonly result in a surface of the cooktop being disposed adjacent to or substantially close to the burners, as shown in FIG. 2D. As a result, in many conventional appliances, a flame 50 from the burner 20 may be close enough to the surface of the cooktop 14 to heat or bake a spill (e.g., liquid or solid) onto the surface of the cooktop, and more particularly, at the interfaces 32 and 34, thereby rendering cleaning of the cooktop more difficult.

Also, in many conventional appliances, a flame from the burner may be close enough to the surface of the cooktop to cause discoloration of the surface of the cooktop, for example, over a period of time and use. The discoloration of the surface may result in an undesirable appearance to a user.

Additionally, in many conventional appliances, the burner is located close to the surface of the pedestal such that the flow of secondary air for contributing to flame production may be inhibited or restricted. For example, as shown in FIG. 2C, the adjacent surfaces of the pedestal 30 and the burner 20 may result in a flow of the secondary air 70 making a sharp bend or turn, which may restrict or choke the supply of secondary air 70 to the flame 50. As shown in FIG. 3, the choking effect may be increased because of an arrangement of a sealed burner, which may limit access to secondary air from other sources, such as within the appliance or under the cooktop surface 14. FIG. 4 shows a non-sealed burner that can draw secondary air 60 from within the appliance or under the cooktop via the opening 40 in the cooktop surface 14. However, the non-sealed burner may restrict or choke the flow of secondary air 70 from above the cooktop surface, which may affect the flame production.

To solve the problems with the conventional appliances, the present invention provides a household appliance, and more particularly, a household cooking appliance having a gas burner, and more particularly, a pedestal for a gas burner of a household appliance.

The aspects of the present invention provide important advantages of improving access to secondary air for flame production while also minimizing the height of the burner with respect to the cooktop surface. The present invention also improves the cleanability of the appliance, and hence, the long term appearance of the appliance. Aspects of the present invention also can minimize or reduce a footprint of the pedestal, thereby further improving the cleanability of the appliance.

More particularly, an aspect can decrease the length of the interface between the burner and the pedestal, and the interface between the pedestal and the cooktop surface, which may decrease the susceptibility of the appliance to trapping or capturing food or spills. By limiting or reducing the length of these interfaces, the aspects of the invention also may decrease the time and difficulty of cleaning around the burner, and more particularly, decrease the time and difficulty of cleaning these interfaces.

An aspect of the invention can raise the burner above the cooktop surface by an amount that may be sufficient to reduce or prevent the flame from heating or baking a spill (e.g., a liquid or solid) onto the surface of the cooktop, thereby improving the ease with which the cooktop can be cleaned. That is, the aspects of the invention can reduce or minimize the radiative energy transferred to the cooktop from the flame of the burner. The invention provides an important advantage of reducing or minimizing the temperature of the surfaces of the appliance that are adjacent to the burner during operation of the burner.

The aspects of the invention also provide an important advantage of increasing a horizontal distance from the flame of the burner to the interface between the burner and the pedestal, thereby further reducing or preventing the flame from the burner from heating or baking a spill (e.g., a liquid or solid) onto the surface of the cooktop, and improving the ease with which the cooktop may be cleaned.

The aspects of the invention also may reduce or prevent discoloration of the surface of the cooktop caused by the flame, for example, over a period of time and use, thereby improving a user's satisfaction with the appearance of the appliance. The aspects of the invention also may provide an appearance that the flames are floating above the surface of the cooktop, which may be visually pleasing to the user.

The aspects of the invention can improve or increase the flow of secondary air for contributing to flame production, thereby improving or increasing the performance of the burner. For example, a pedestal and burner according to an aspect can reduce or prevent a restriction or choking of the flow of secondary air to the flame kernel. Accordingly, the aspects of the invention can maintain appropriately sized flame kernels throughout the irregular pattern (e.g., star-shaped pattern) of flame kernels throughout the cooktop area, and particularly when a sealed burner arrangement is provided.

Aspects of the invention also can improve or increase the flow of secondary air from within the appliance or under the cooktop, which may improve the flame production. More particularly, an aspect provides an internal path for the flow of secondary air from within the appliance or under the cooktop. Accordingly, the present invention can provide the advantages of both a sealed burner and a non-sealed burner. The present invention also can minimize or eliminate the disadvantages of the conventional sealed burner and/or non-sealed burner.

The present invention also provides an important advantage of reducing costs, such as manufacturing costs associated with the appliance. For example, an aspect of the present invention may take the place of the "volcano-type" pedestal such that the cooktop surface may be provided with a flat surface. These aspects may reduce the complexity and costs associated with manufacturing the cooktop surface, since the "volcano-type" pedestal may not be formed in the cooktop surface. In other aspects, the pedestal may be provided on a "volcano-style" pedestal. The pedestal may provide important advantages such as reducing the size of the "volcano-style" pedestal, which may reduce the complexity and costs associated with producing the "volcano-style" volcano pedestal on the cooktop.

Furthermore, the cooktop surface can be formed from a variety of materials that otherwise may not be suitable for the "volcano-style" pedestal or for which forming a "volcano-style" pedestal may be difficult or costly. For example, one of ordinary skill in the art will recognize that forming a glass cooktop surface with an integrally formed pedestal may be more difficult and costly as compared to forming a similar pedestal in a steel cooktop. The aspects of the present invention provide important advantages in that the cooktop surface can be formed from a variety of materials, such as a glass surface, a steel surface, a stainless steel surface, a porcelain surface, a painted surface, or another suitable surface.

In view of the above aspects of the invention, an exemplary aspect is directed to a gas burner for a household cooking appliance. The gas burner includes a burner portion, and a pedestal portion under the burner portion for elevating the burner portion above a cooktop surface of the household cooking appliance. The pedestal portion includes a base portion for mounting with the cooktop surface of the household cooking appliance, and an upper portion that interposes the base portion and the burner portion, and interfaces with the burner portion. A perimeter of the base portion has no mathematical correlation to one of a perimeter of the burner portion and a perimeter of the upper portion.

Another exemplary aspect is directed to a pedestal for a gas burner of a household cooking appliance. The pedestal includes a base portion for mounting with a cooktop surface of the household cooking appliance, and an upper portion formed on the base portion and configured to support the gas burner of the household appliance. A perimeter of the base portion has no mathematical correlation to a perimeter of the upper portion.

Another exemplary aspect is directed to a household cooking appliance including a cooktop surface having an opening, a gas burner over the opening of the cooktop surface, wherein the gas burner has a plurality of finger portions, and a pedestal interposing the cooktop surface and the gas burner for elevating the gas burner above the cooktop surface. The pedestal includes a base portion supported by the cooktop surface, and an upper portion supporting the gas burner. A perimeter of the base portion has no mathematical correlation to one of a perimeter of the gas burner and a perimeter of the upper portion.

The features of the invention, however, together with additional aspects, objects and advantages thereof will be best understood from the following description of exemplary aspects when read in connection with the accompanying drawings.

BRIEF DESCRIPTION OF THE DRAWINGS

The accompanying drawings are presented to aid in the description of aspects of the invention and are provided solely for illustration of the aspects and not limitation thereof.

DETAILED DESCRIPTION

Figure 1:
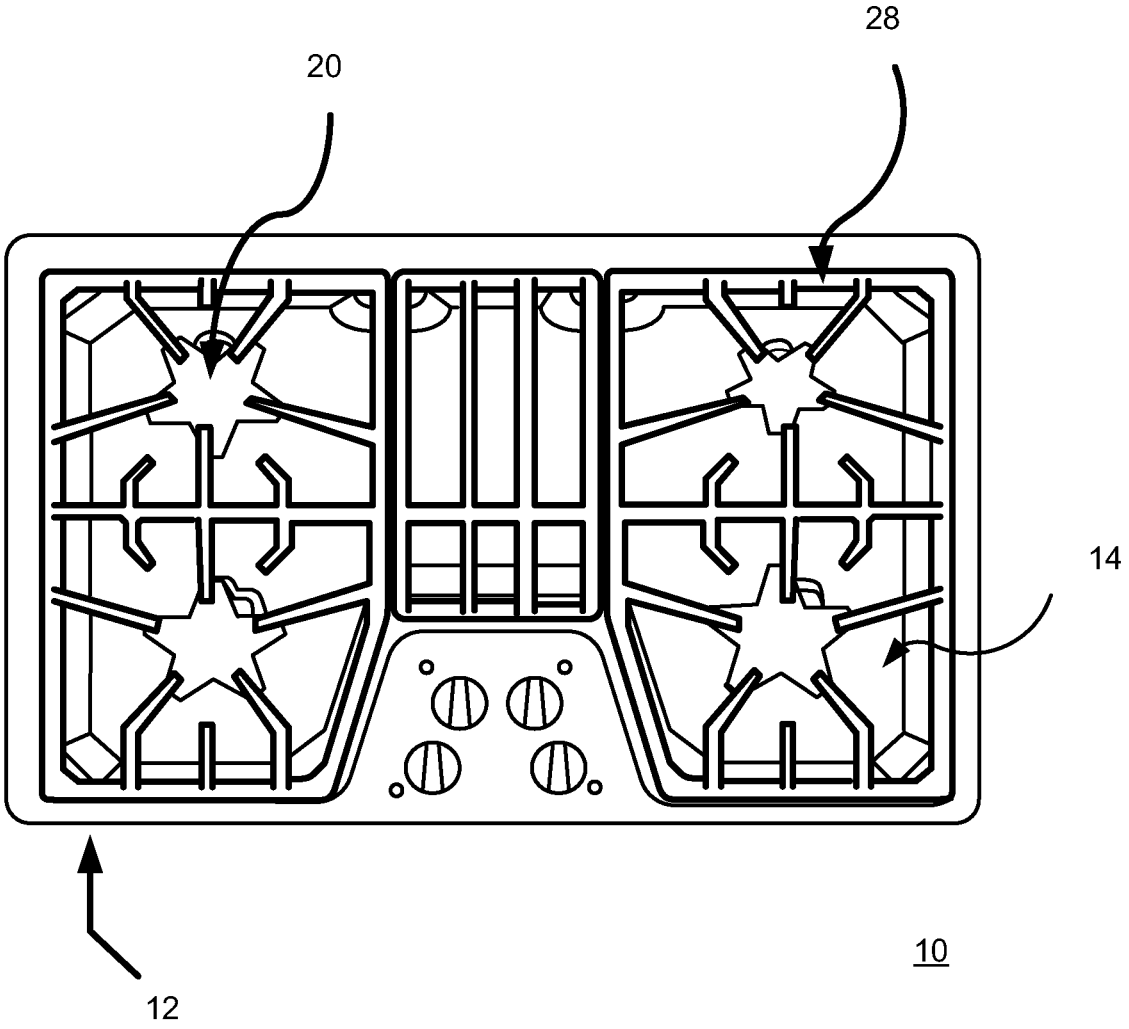
FIG. 1 CONVENTIONAL ART
FIG. 1 is a top view of a conventional cooking appliance.
Figure 2A:
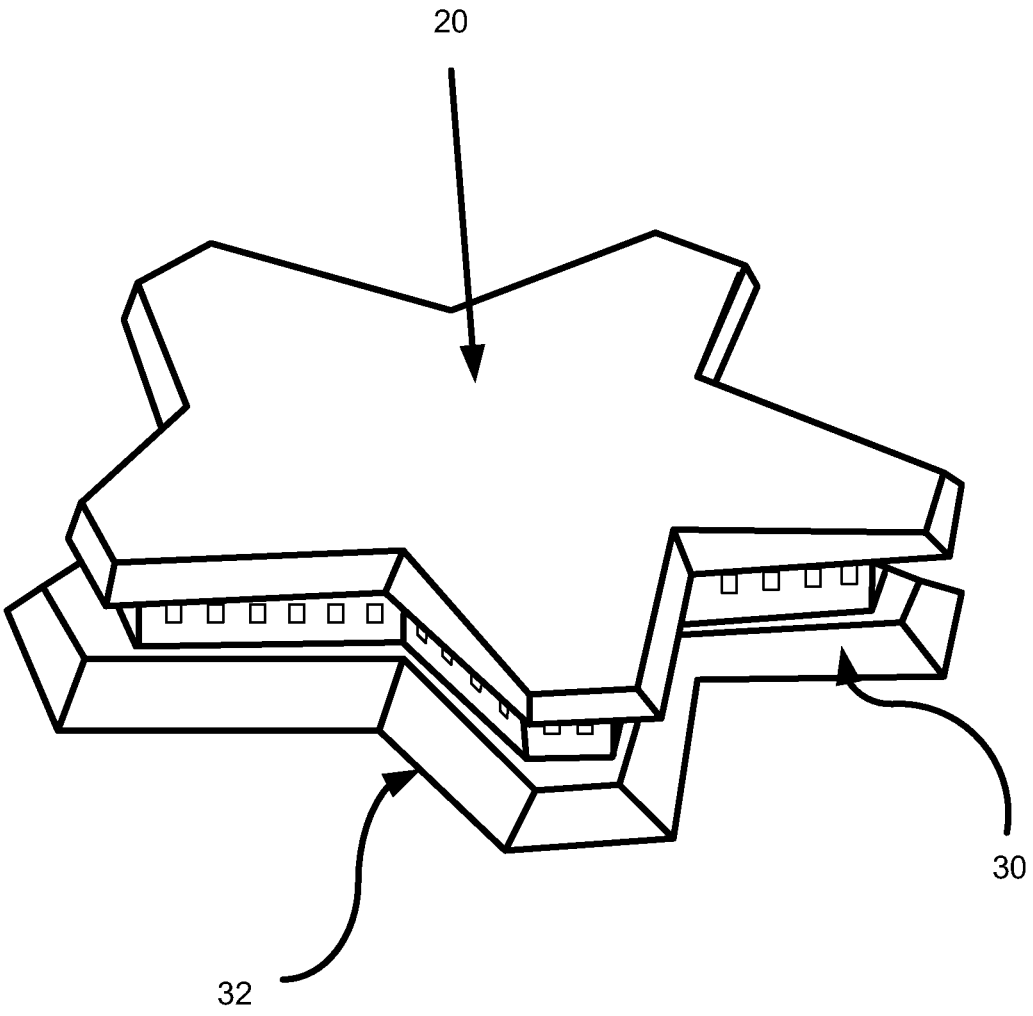
FIG. 2A CONVENTIONAL ART
FIG. 2A is a perspective view of a conventional burner assembly.
Figure 2B:
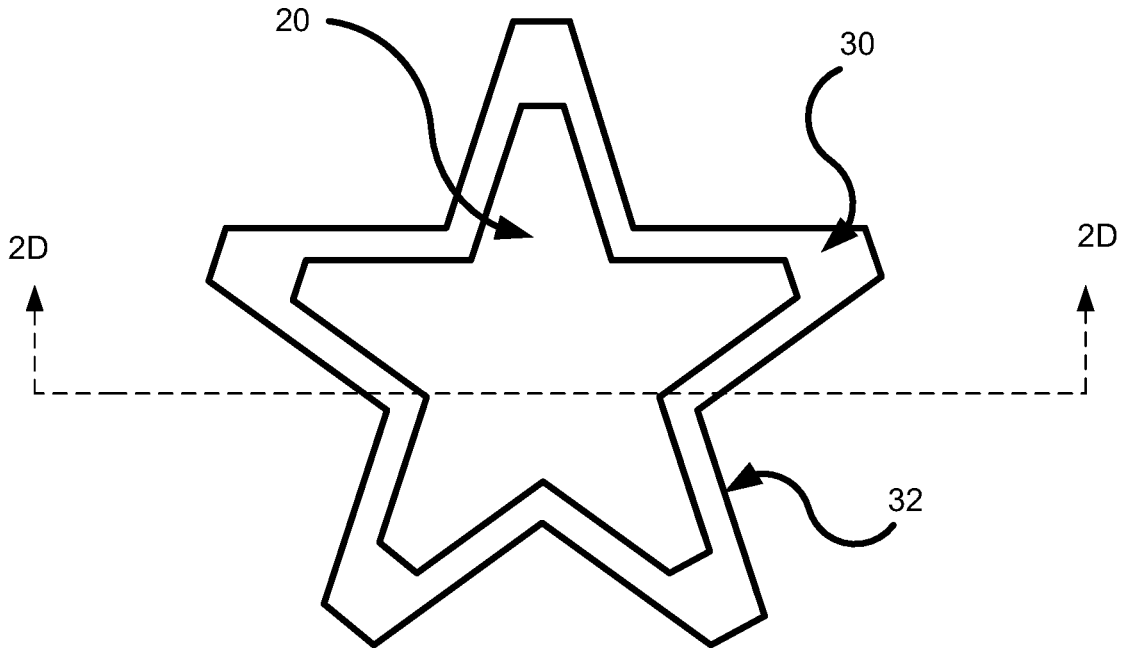
FIG. 2B CONVENTIONAL ART
FIG. 2B is a top view of the conventional burner assembly of FIG. 2A.
Figure 2C:
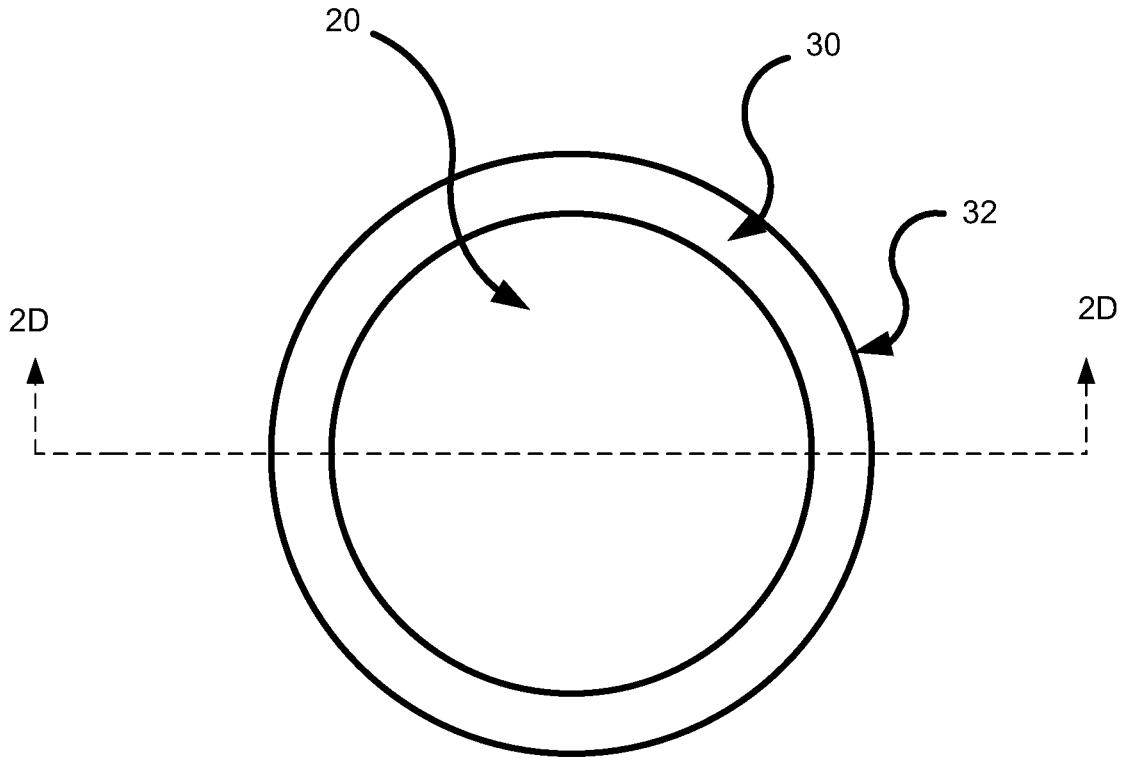
FIG. 2C CONVENTIONAL ART
FIG. 2C is a top view of another conventional burner assembly.
Figure 2D:
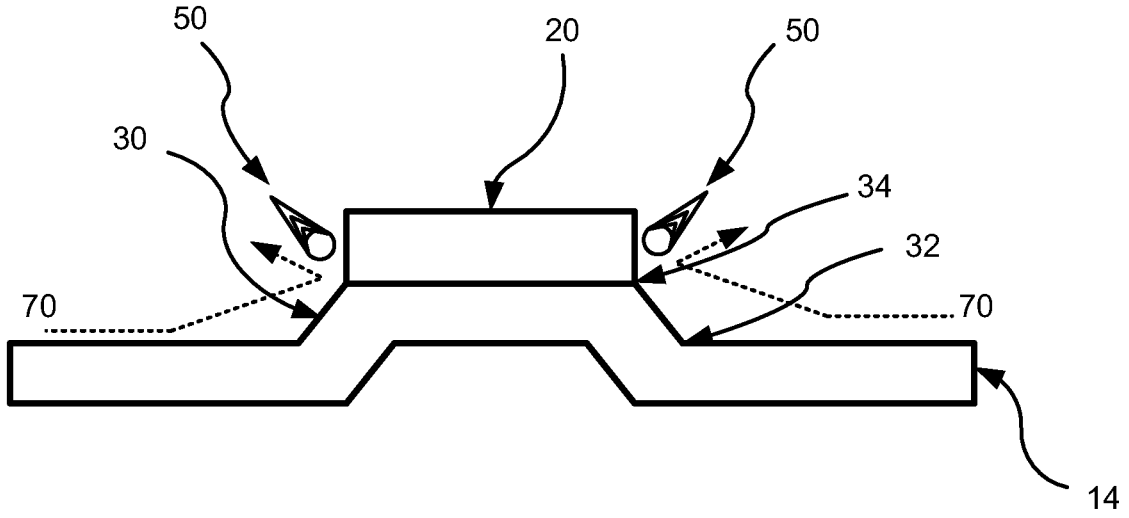
FIG. 2D CONVENTIONAL ART
FIG. 2D is a cross-sectional view of the conventional sealed burner assemblies of FIGS. 2B and 2C.
Figure 3:
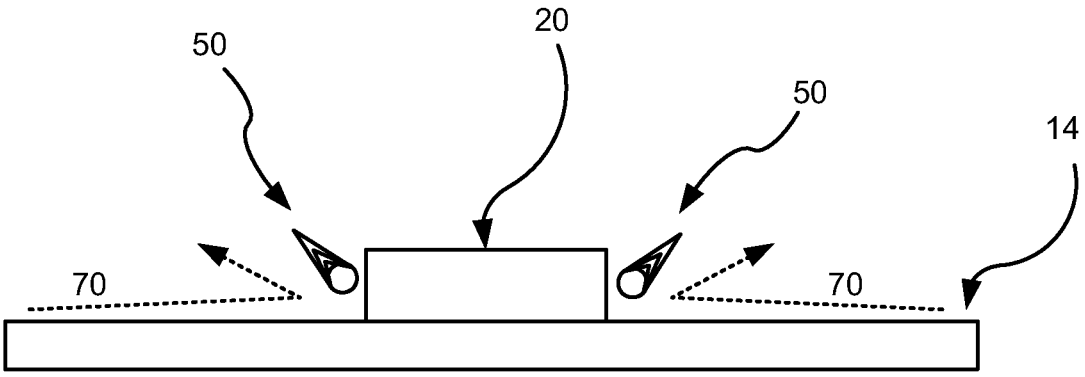
FIG. 3 CONVENTIONAL ART
FIG. 3 is a partial cross-sectional view of a conventional household cooking appliance having a sealed burner.
Figure 4:
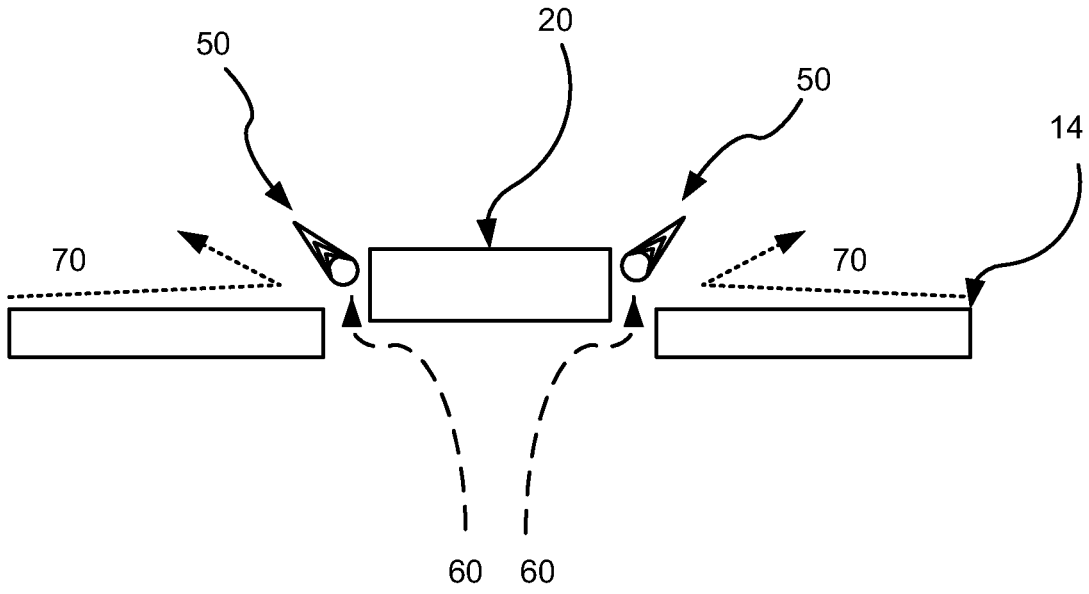
FIG. 4 CONVENTIONAL ART
FIG. 4 is a partial cross-sectional view of a conventional household cooking appliance having a non-sealed burner.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

With reference to FIGS. 5-11, exemplary embodiments of the invention will now be described.

Figure 5:
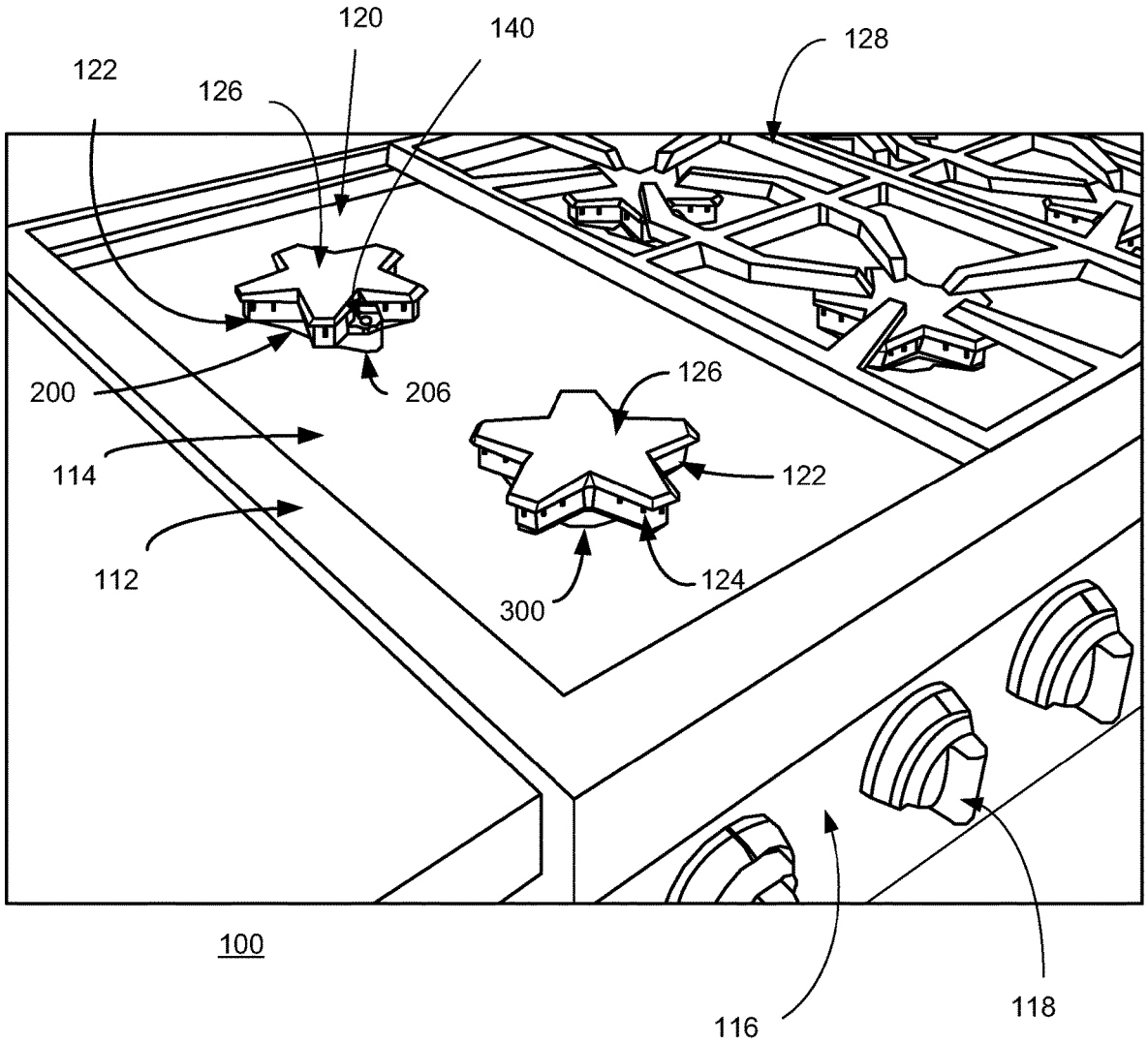
FIG. 5 is a perspective view illustrating a household cooking appliance according to an embodiment of the invention.

Referring to FIG. 5, a cooking appliance 100 is shown having a housing 112 and a cooktop surface 114. The cooktop surface 114 includes a plurality of burners 120. The housing 112 supports a grate 128 to support a cooking utensil, such as a pot, pan or kettle over the burner 120. The cooktop surface 114 has a plurality of openings (e.g., see FIG. 6) defining the positions for each of the burners 120. In an aspect, the cooktop surface 114 forms a sealed burner arrangement which is discussed in greater detail below.

Each burner 120 includes a burner body 122 and a burner head 126 that covers the burner body 122 to prevent leakage or overspills from cooking utensils from entering the burner 120. The burner body 122 in this aspect has a plurality of fingers that form a star configuration and the burner head 126 has a corresponding star configuration. However, the burner body 122 and burner head 126 may have other configurations and shapes, such as a circular or oval shape, or another number of fingers. Each burner 120 is elevated above the cooktop surface 114 by a pedestal 200, which will be described in greater detail below. The burner body 122 has a plurality of burner ports 124. An ignitor 140 is provided for igniting the air-gas mixture flowing from the burner ports 124. In this aspect, the ignitor 140 is mounted on an ignitor surface 206 of the pedestal 200.

A plurality of control knobs 118 are carried on valve stems (not shown) protruding through openings in the control panel 116, as shown in FIG. 5, or alternatively, in the cooktop surface 114. The control knobs 118 are used to control a valve for flow of gas and the ignition of each of the burners 120 in a well known manner. The openings may contribute to the availability of secondary air within the appliance since the openings are not positioned where leakage or overspills from cooking utensils will expose the burner 120 or the ignitor to clogs or blockages that may interfere with operation of the burners 120. In another embodiment, the cooking appliance 100 may have an electronic, electromechanical, or mechanical control valve in place of the control knobs 118.

Figure 6:
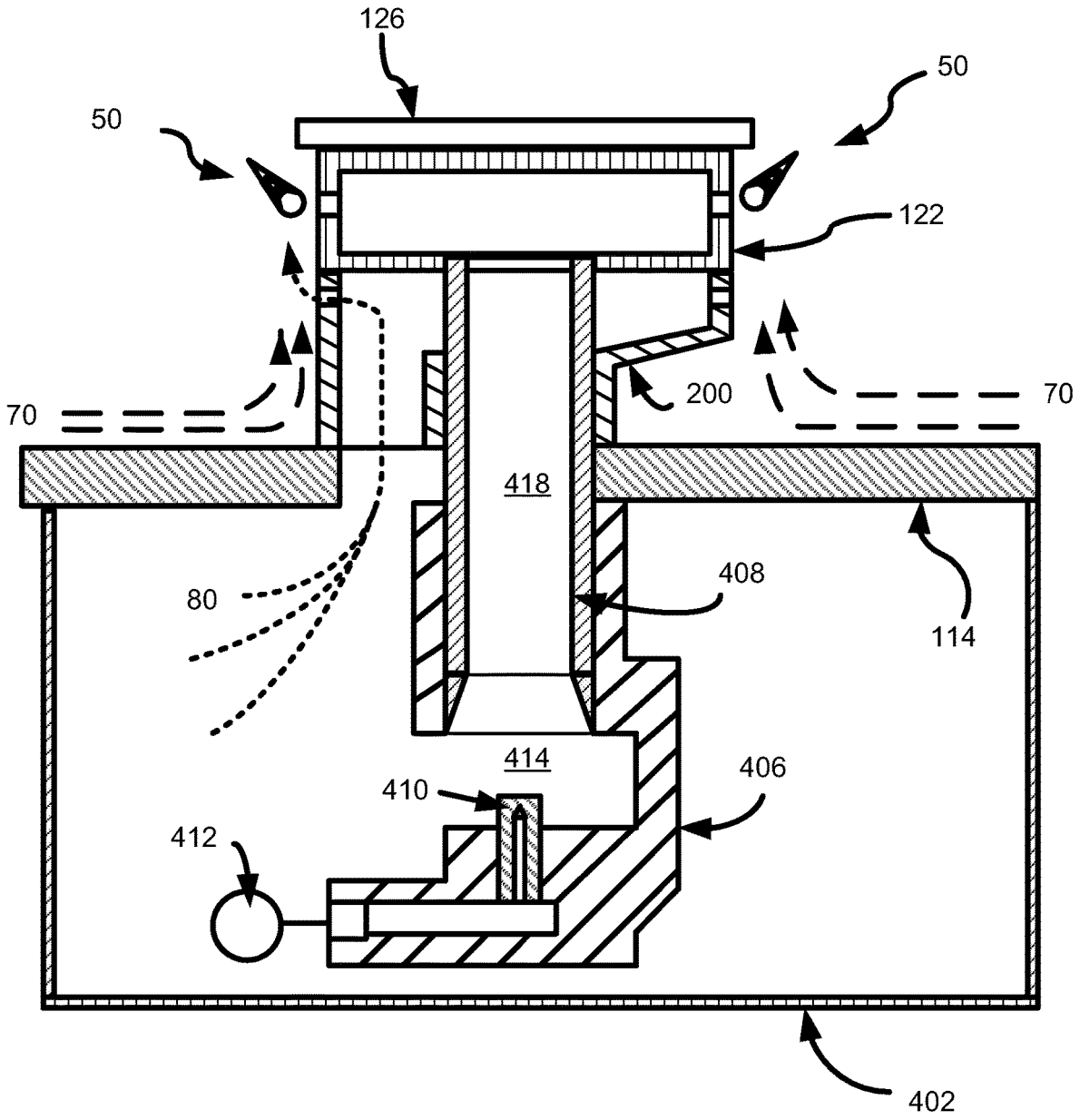
FIG. 6 is a partial cross-sectional view of a household cooking appliance according to an embodiment of the invention.

Referring to FIG. 6, the housing 112 has an interior box or a rough-in box 402 that encloses the cooktop controls and gas nozzle 410 inside a cooking appliance 100, such as a range, or under a cooktop for installation in a rough-in opening in a cabinet or countertop. The rough-in box 402 may include a bottom wall to prevent spillage through the cooktop openings from soiling the interior of the range or cabinet. In addition, the rough-in box 402 may provide support for a jet holder 406. An additional bracket also may be provided to support the jet holder 406.

As shown in FIG. 6, a venturi tube 408 includes an elongated body having a venturi passage 418. The body of the venturi tube 408 may include an exterior, threaded portion adapted to receive a nut to lock the venturi tube 408 into position in the opening of the cooktop surface 114, under the cooktop surface 114, or inside or on the pedestal 200. The lower end of the venturi tube 408 is received in a jet holder 406 and the upper end of the venturi tube 408 is received in an opening 224 of the pedestal 200, which will be described in greater detail below. The jet holder 406 may be supported by the rough-in box 402 or another support. The jet holder 406 may be mounted in the opening of the cooktop surface 414 or under the cooktop surface 114. The jet holder 406 positions a gas nozzle 410 for introducing gas for mixture with air and entry into the venturi passage 418 as is known conventionally. The nozzle 410 is coupled to a supply of gas 412 and discharges the fuel to a mixing zone 414 adjacent the entry to the venturi passage 418.

In operation, the supply of gas 412 is delivered through the nozzle 410 and mixed with air at the mixing zone 414. The air-gas mixture enters the venturi passage 418 for delivery to the burner 120. The air-gas mixture then passes through the burner ports 124 such that, upon ignition by an appropriate ignitor 140, a flame 50 may be initiated and sustained at the exterior of the burner head 126 of the burner 120.

As shown in FIG. 6, aspects of the pedestal 200 can improve the flow of secondary air 70 to the flame 50. The pedestal 200 also can include a plurality of slots 240 formed in the pedestal 200, which will be described in greater detail with reference to FIGS. 10 and 11. The slots 240 may further improve flame production by providing access to an additional volume of secondary air 80 from within the pedestal 200 or under the pedestal 200 and the cooktop 114. It is noted that other arrangements of the burner 120, pedestal 200, venturi tube 408, and gas nozzle 410 may be provided without departing from the spirit and scope of the present invention. For example, in another aspect, the venturi tube 408 may be integrally formed with the pedestal 200.

Referring again to FIG. 5, each burner 120 is elevated above the cooktop surface 114 by a pedestal 200. In this illustrative aspect, an ignitor 140 for igniting the air-gas mixture flowing from the burner ports 124 is mounted on an ignitor surface 206 of the pedestal 200.

Figure 7:
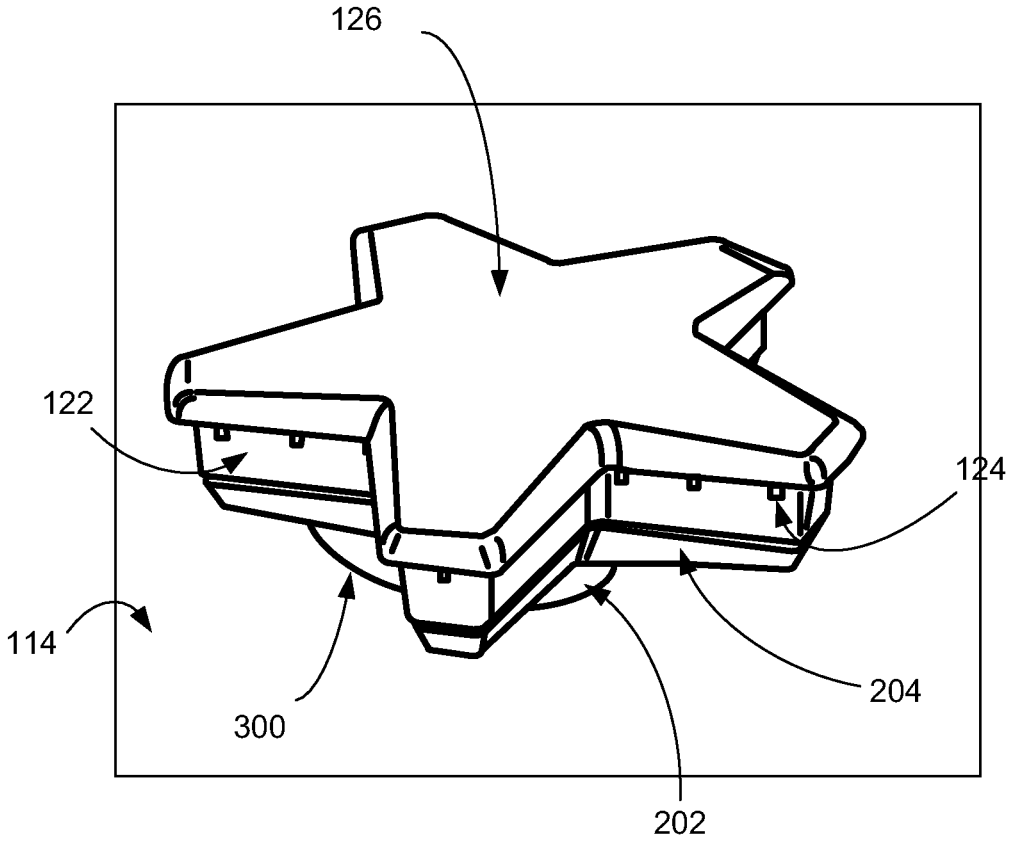
FIG. 7 is a perspective view of a plurality-fingered burner assembly for a household cooking appliance according to an embodiment of the invention.
Figure 8:
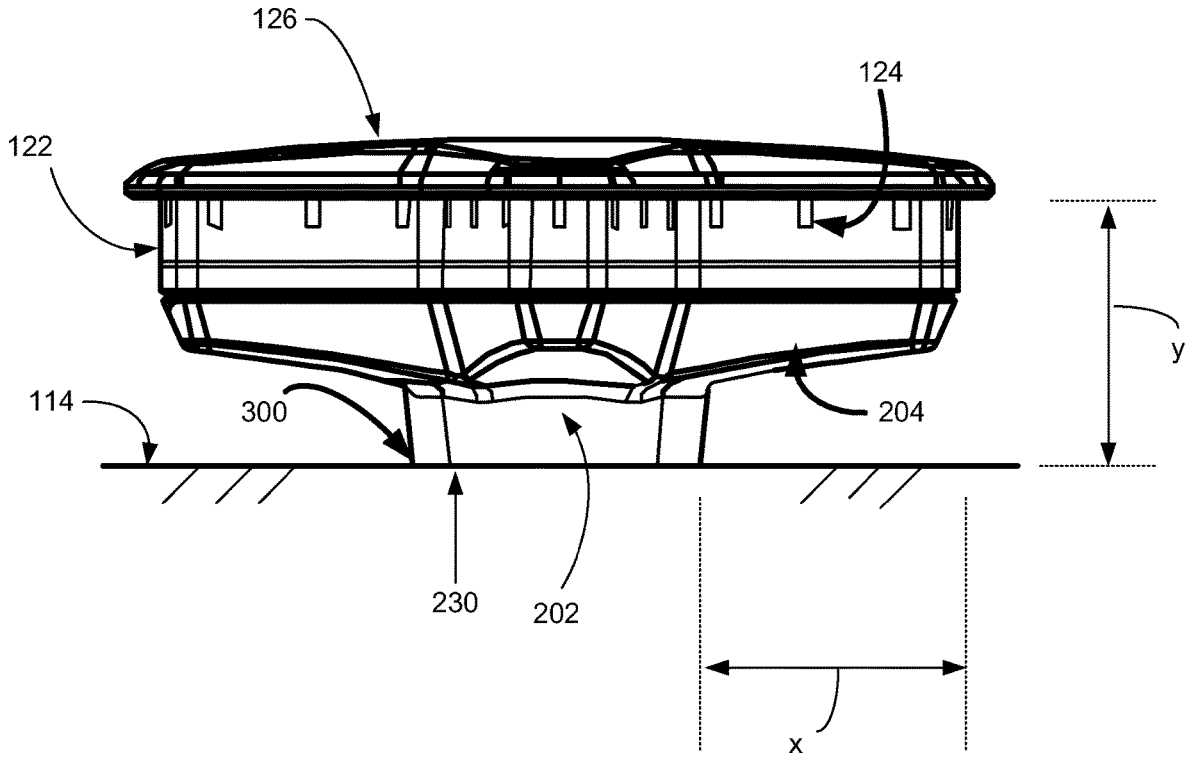
FIG. 8 is a side view of a plurality-fingered burner assembly for a household cooking appliance according to an embodiment of the invention.
Figure 9A:
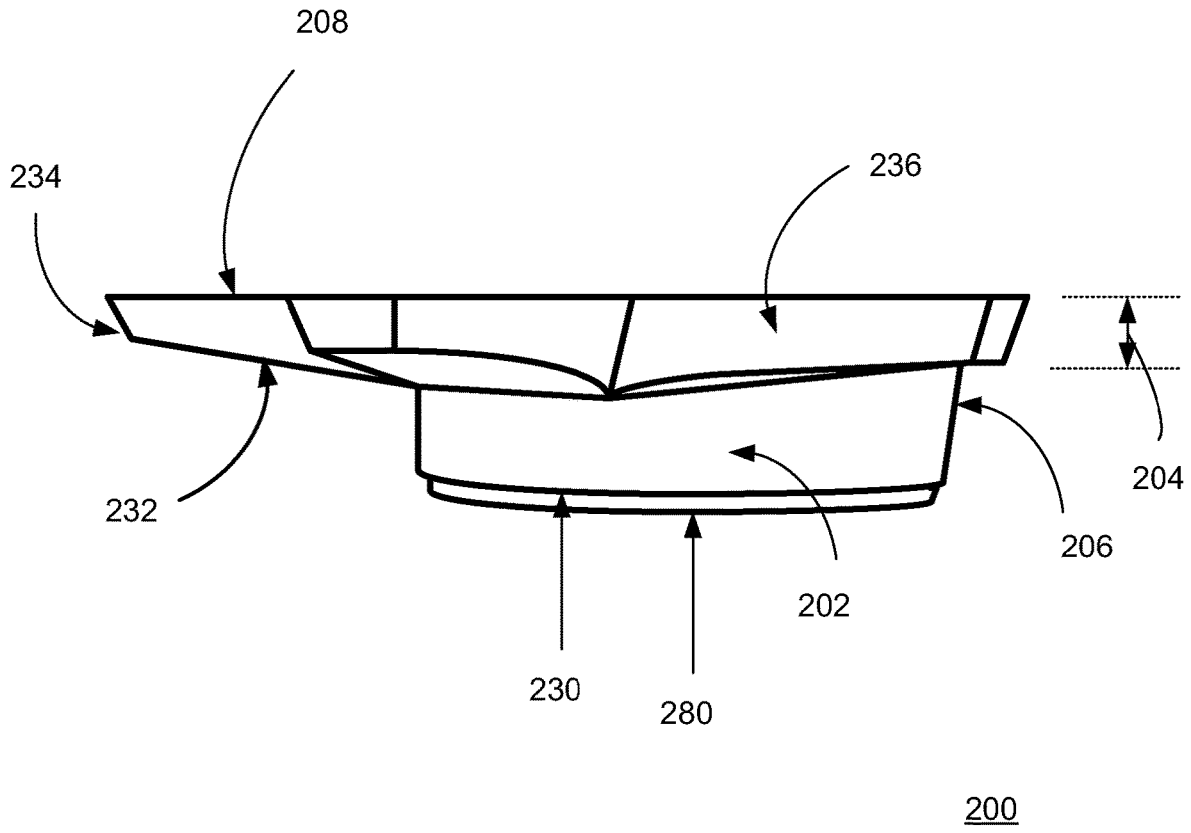
FIG. 9A is a first side view of a pedestal for a household cooking appliance according to an embodiment of the invention.
Figure 9B:
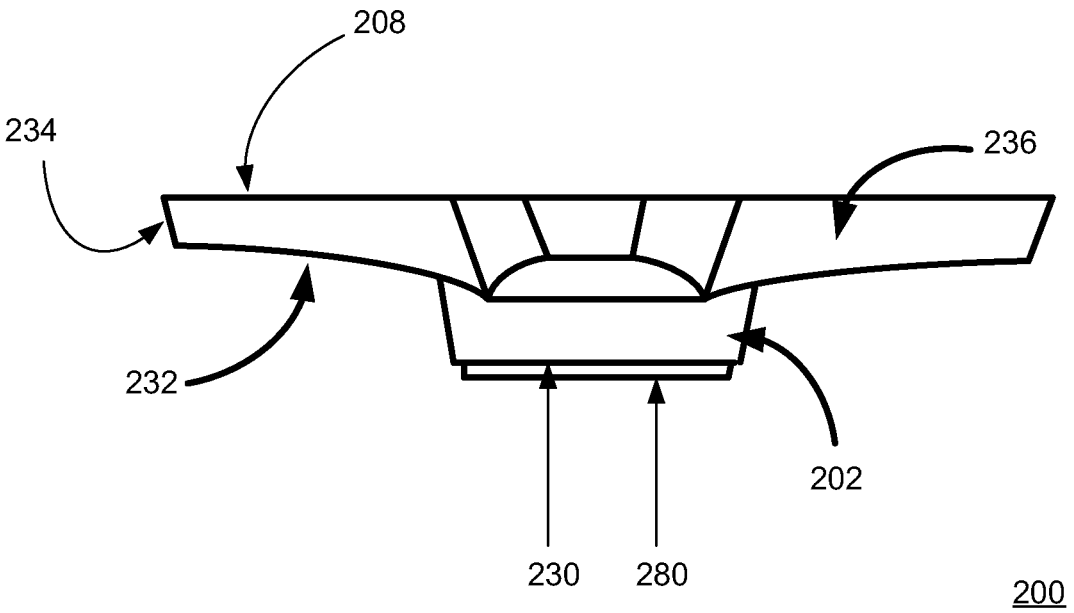
FIG. 9B is a second side view of a pedestal for a household cooking appliance according to an embodiment of the invention.
Figure 9C:
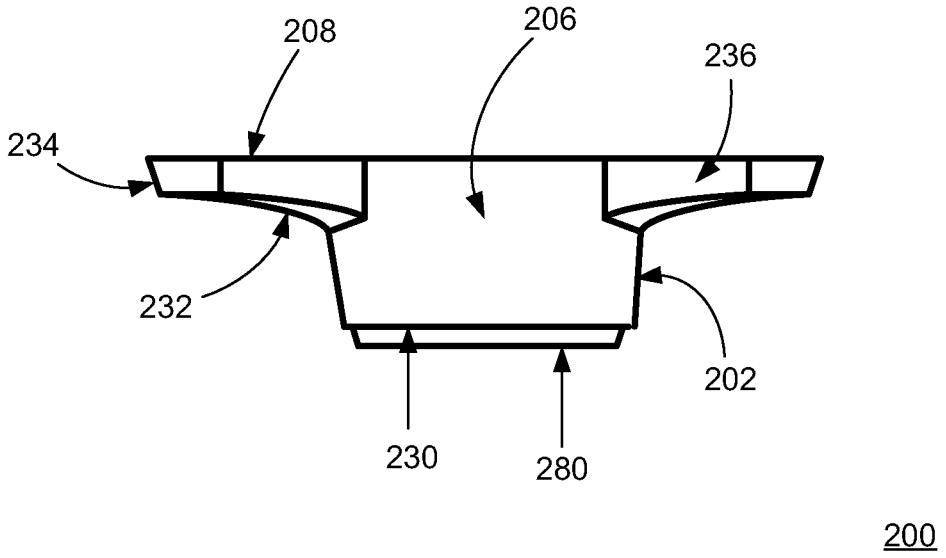
FIG. 9C is a third side view of a pedestal for a household cooking appliance according to an embodiment of the invention.
Figure 9D:
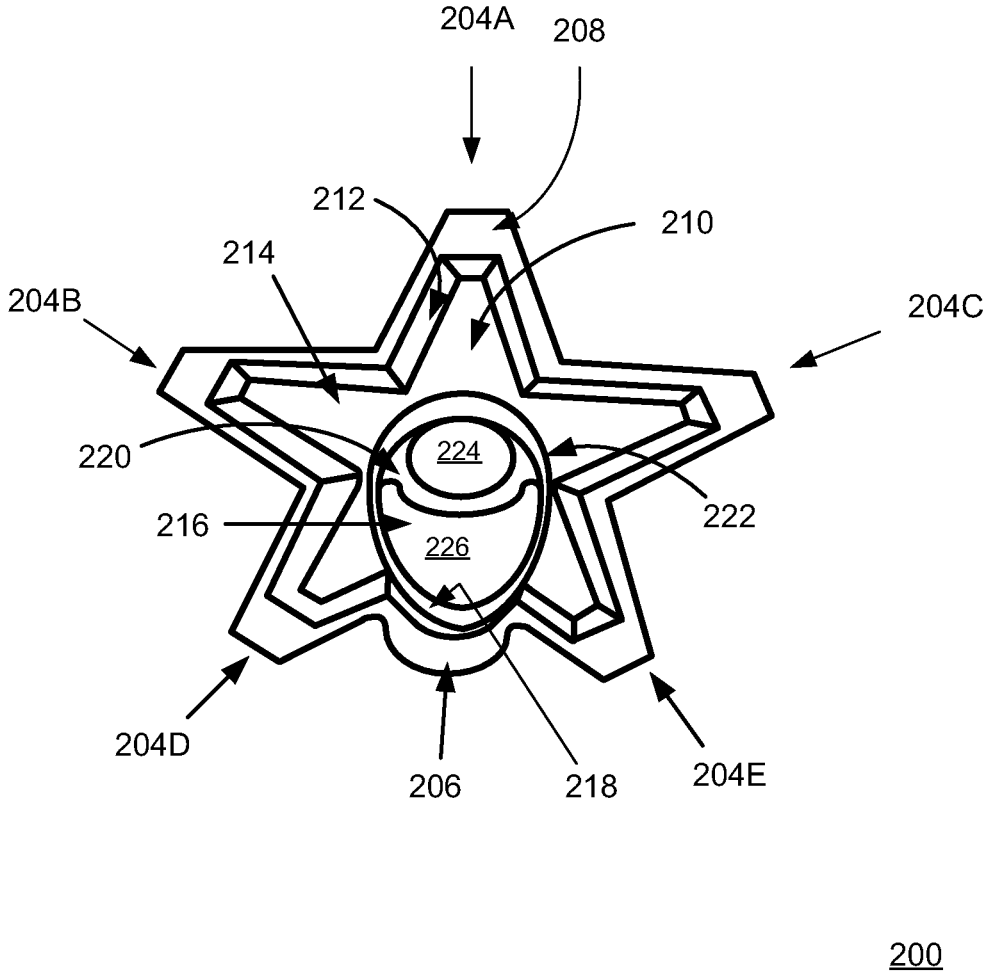
FIG. 9D is a top view of a pedestal for a household cooking appliance according to an embodiment of the invention.
Figure 9E:
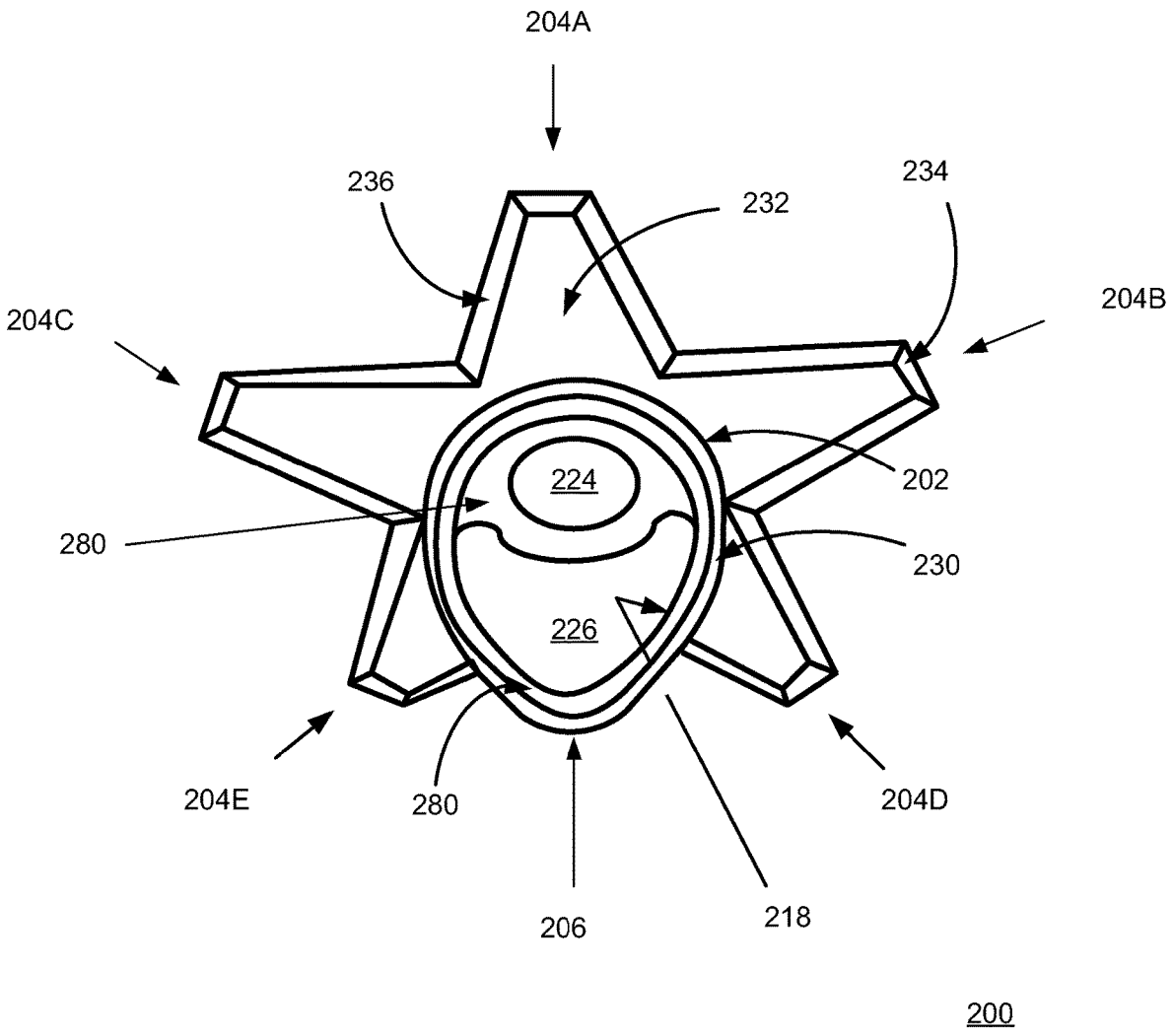
FIG. 9E is a bottom view of a pedestal for a household cooking appliance according to an embodiment of the invention.
Figure 9F:
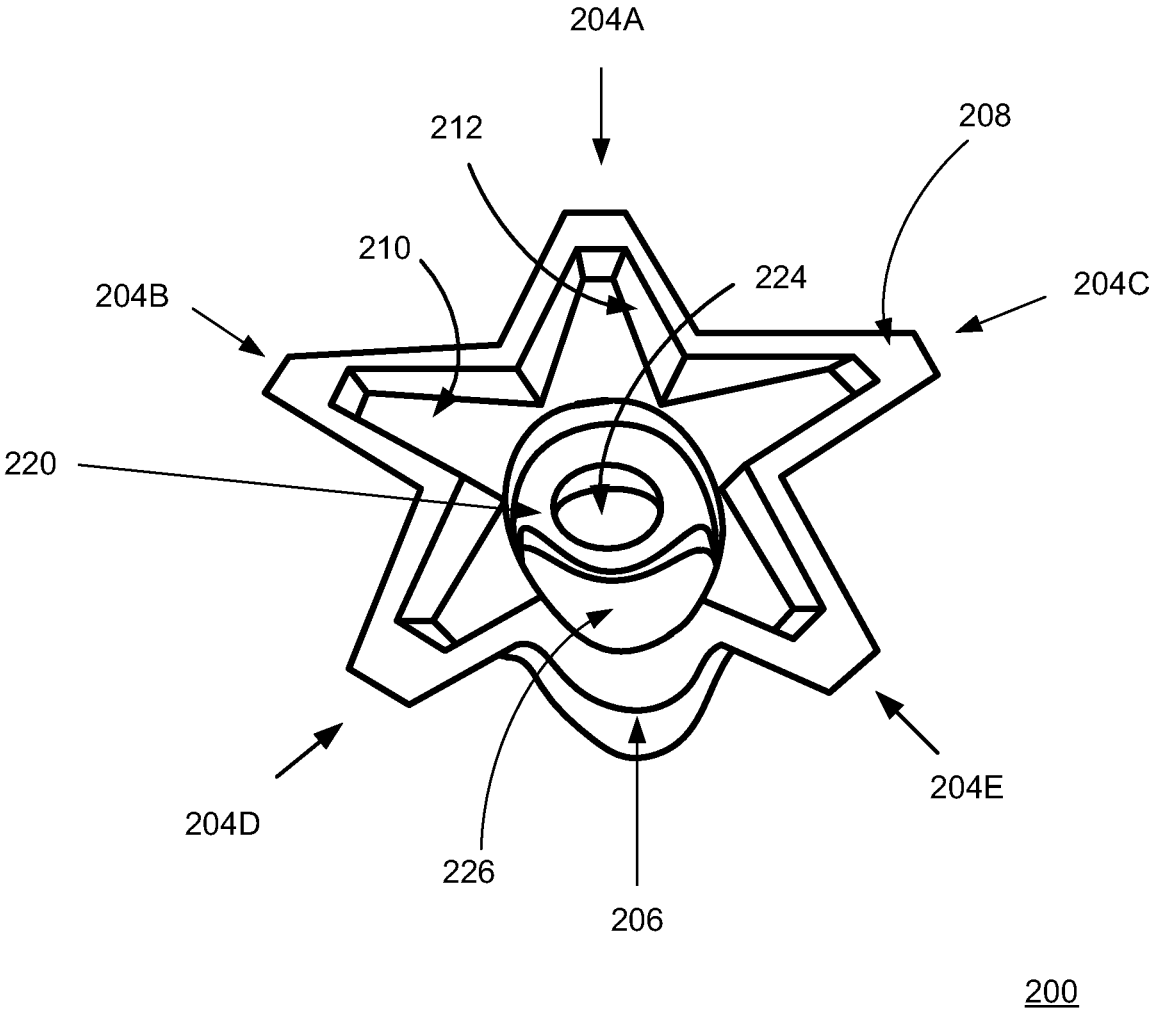
FIG. 9F is a perspective view of a pedestal for a household cooking appliance according to an embodiment of the invention.
Figure 9G:
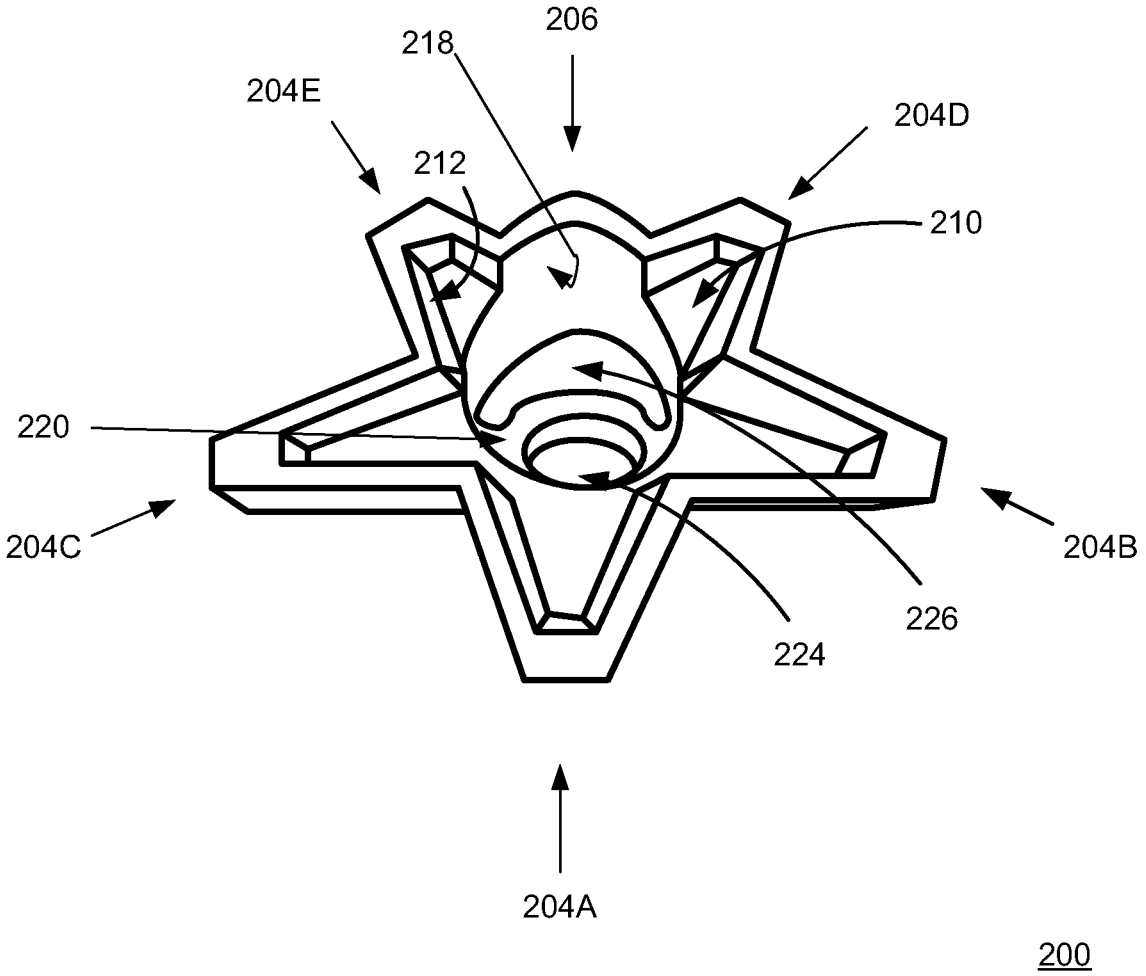
FIG. 9G is a perspective view of a pedestal for a household cooking appliance according to an embodiment of the invention.

Referring to FIGS. 7 and 8, the burner 120 includes a burner body 122 having a plurality of fingers. In this aspect, the burner 120 has five fingers that form a star configuration. One of ordinary skill in the art will recognize that other numbers of fingers and configurations can be provided, such as round or oval burners. A burner head 126 having a plurality of fingers covers the burner body 122 to prevent leakage or overspills from cooking utensils from entering the burner 120. The burner body 122 and burner head 126 define an interior chamber. The burner body 122 includes a plurality of recesses forming burner ports 124. The burner ports 124 are in fluid communication with the chamber and the exterior of the burner 120 for permitting flow of the air-gas mixture from the burner 120.

Referring again to FIGS. 6-8, the burner 120 is supported by or mounted on a pedestal 200. The burner 120 and pedestal 200 also may be integrally formed. Similarly, the burner body 122 and the pedestal 200 may be integrally formed. The pedestal 200 elevates the burner 120, thereby increasing a vertical distance y (e.g., a predetermined vertical distance) between the flames of the burner 120 and the cooktop surface 114, thereby reducing or preventing the flame from the burner from heating or baking a spill (e.g., a liquid or solid) onto the surface of the cooktop, and improving the ease with which the cooktop can be cleaned.

The pedestal 200 includes a pedestal body (i.e., base portion) 202 having a lower surface 230 that is mounted on the cooktop surface 114. In another aspect, the pedestal body 202 can include a recessed portion 280 that is received in an opening of the cooktop surface 114 to secure the pedestal to the cooktop surface 114.

FIG. 8 shows the intersection or interface 300 of the lower surface 230 of the pedestal body 202 with the cooktop surface 114. The footprint (e.g., the size, area, length, size and shape (or outline), length and shape (or outline), or area and shape (or outline), etc.) of the lower surface 230 of the pedestal body 200 has no correlation (e.g., no mathematical correlation) with the bottom, or footprint, of the burner 120. For example, in an aspect, the size and shape of the footprint of the pedestal body 202 is independent from the size and shape of the footprint of the burner 120. In another aspect, the area and/or the length of the perimeter of the footprint of the pedestal body 202 is less than the area or the length of the perimeter of the burner 120. The pedestal body decouples the footprint of the burner 120 from the cooktop surface 114.

The pedestal 200 includes an upper portion 204, which may have a plurality of fingers (e.g., 204A, 204B, 204C, 204D, 204E). In this aspect, the upper portion 204 has five fingers that form a star configuration corresponding to the star configuration of the burner 120. One of ordinary skill in the art will recognize that other numbers of fingers and configurations can be provided. Other pedestal configurations also are possible. For example, the upper portion 204 of the pedestal 200 may have a circular or oval shaped configuration.

As shown in FIG. 8, the upper portion 204 of the pedestal 200 increases a horizontal distance x (e.g., a predetermined horizontal distance) between the flames of the burner 120 and the interface 300 between the pedestal 200 and the cooktop surface 114, thereby reducing or preventing the flame from the burner 120 from heating or baking a spill (e.g., a liquid or solid) onto the surface of the cooktop, and more particularly at the interface 300 which is more difficult to clean, and improving the ease with which the cooktop surface 114 may be cleaned.

Referring to FIGS. 9A-9G, exemplary embodiments of a pedestal 200 will now be described in greater detail. As explained above, the pedestal 200 includes a pedestal body 202 having a lower surface 230 for mounting on the cooktop surface 114. In another aspect, the pedestal body 202 can include a recessed portion 280 for being received in an opening of the cooktop surface 114 to secure the pedestal to the cooktop surface 114.

The pedestal 200 also includes an upper portion 204 formed on the pedestal body 202. The upper portion 204 can be integrally formed with the body portion 202 or coupled to the body portion 202. The upper portion 204 has a plurality of fingers (e.g., 204A, 204B, 204C, 204D, 204E). Each of the plurality of fingers of the upper portion 204 has a lower surface 232, an end surface 234, a pair of side surfaces 236, and an upper surface 208. The upper surface 208 receives or supports the burner body 122. In an aspect, one or more of the lower surface 232, the end surface 234, or the side surfaces 236 can be tapered or curved to improve flow of secondary air along the surface of the pedestal 200.

Referring to FIGS. 9D-9G, the pedestal 200 includes an upper cavity 214 formed in the upper portion 204 and a lower cavity 216 formed in the base portion 202. The upper cavity 214 is formed by a recessed surface 210 and an upper wall surface 212. In this aspect, the recessed surface 210 is angled with respect to a plane of the upper surface 208, or tapered downward toward the lower cavity 216, for example, to minimize or reduce the resistance to the flow of the additional volume of secondary air 80 in the pedestal 200. The upper wall surface 212 also may be angled or tapered with respect to the upper surface 208 and the recessed surface 210.

Figure 10:
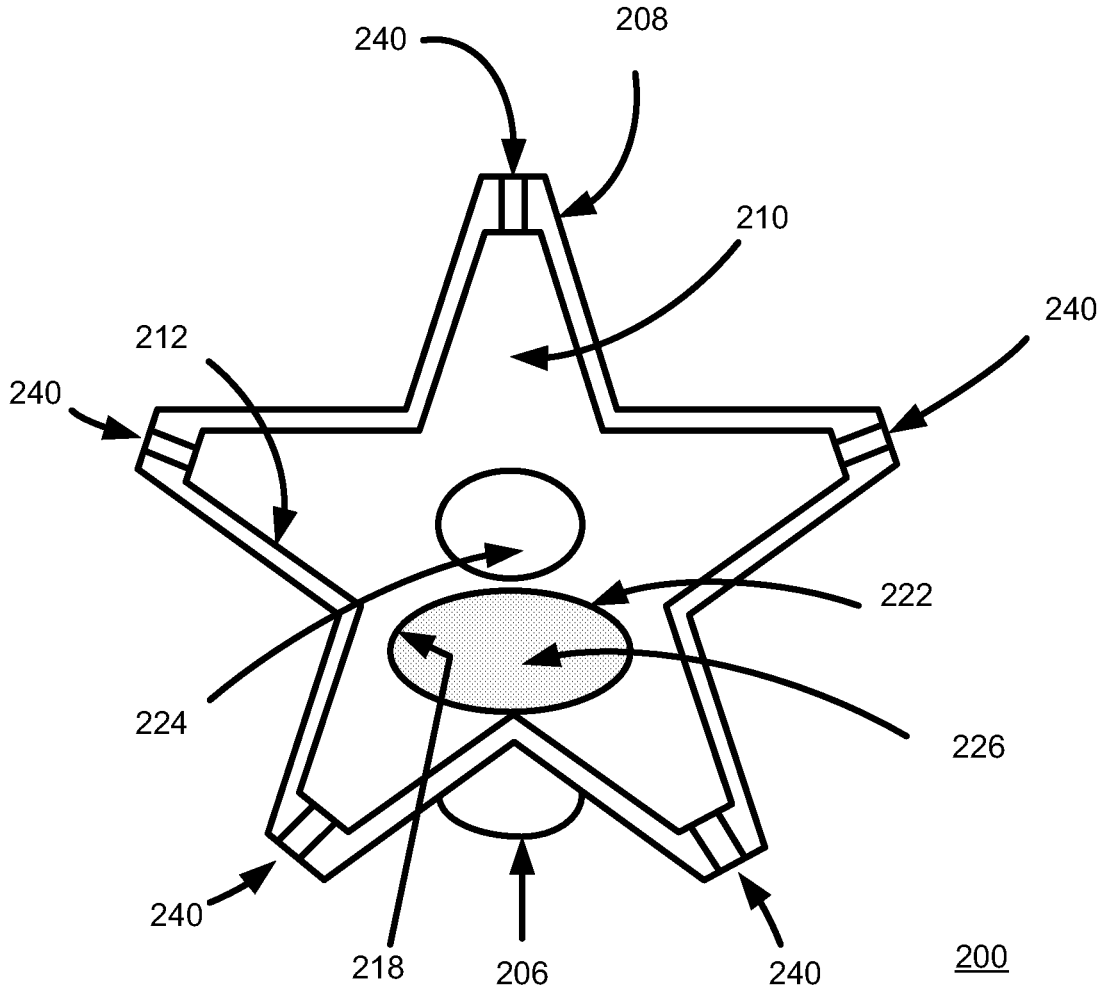
FIG. 10 is a top view of a pedestal for a household cooking appliance according to an embodiment of the invention.

Alternatively, the recessed surface 210 can be parallel to a plane of the upper surface 208 of the pedestal 200, as shown in the aspect illustrated in FIG. 10. In another aspect, the upper wall surface 212 can be perpendicular to the upper surface 208 and/or the recessed surface 210. One of ordinary skill in the art will recognize that various combinations of perpendicular, parallel, angled, tapered, and/or curved upper wall surfaces and recessed surfaces may be provided.

Referring again to FIGS. 9A-9G, the recessed surface 210 has an opening 222 such that the upper cavity 214 is in fluid communication with the lower cavity 216. The lower cavity 216 is defined by a lower wall surface 218 and an inside bottom surface 220. The inside bottom surface 220 includes a first opening 224 and a second opening 226 that extend through the lower surface 230 of the pedestal 200 such that the lower cavity 216 is in fluid communication with the exterior of the pedestal 200. As shown in FIG. 6, the first opening 224 receives the venturi tube 408 for facilitating flow of the air-gas mixture from the mixing zone 414 through the pedestal 200 and into the burner 120, where the air-gas mixture then exits the burner through the burner ports 124. The second opening 226 facilitates flow of an additional volume of secondary air 80 from under the cooktop surface 114 through lower cavity 216 and upper cavity 214 of the pedestal 200 and out of the slots 240 of the pedestal to the flame 50.

In another aspect, the lower cavity 216 can be formed by the first opening 224 and the second opening 226, as shown in FIG. 10. One of ordinary skill in the art will recognize that various cavity configurations are possible for promoting the flow of the air-gas mixture through the pedestal 200 to the burner 120, and for promoting the flow of an additional volume of secondary air 80 from under the cooktop surface 114 to the flame 50.

Referring again to FIGS. 9A-9G, the pedestal 200 can include an integral ignitor support 206 that extends radially from a center of the star configuration and between two fingers of the star configuration of the pedestal. An ignitor 140 can be mounted on or in the ignitor support 206 for igniting the air-gas mixture of the burner 120. In other aspects, the ignitor support 206 may not be integrally formed with the pedestal 200. In these aspects, the ignitor and/or ignitor support can be separate from the pedestal and disposed adjacent to the pedestal at a height and/or distance that is sufficient for igniting the air-gas mixture from the burner 120.

Figure 11:
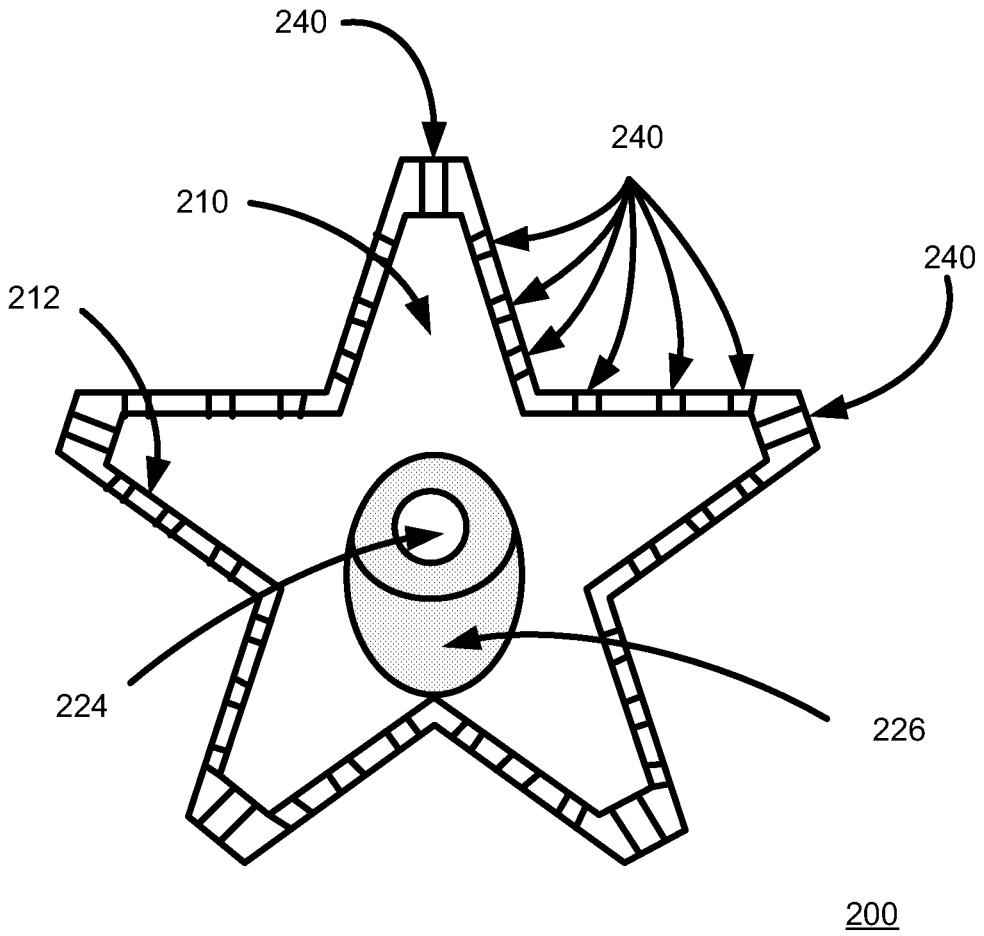
FIG. 11 is a top view of a pedestal for a household cooking appliance according to an embodiment of the invention.

Referring to FIGS. 10 and 11, the pedestal 200 can include a plurality of slots 240 formed in the upper portion 204 of the pedestal 200. The slots 240 provide fluid communication between the upper cavity 214 of the pedestal 200 and the exterior of the pedestal 200, which may improve flame production by providing access to an additional volume of secondary air 80 from within the pedestal 200 or under the pedestal 200 and cooktop 114. The slots 240 may be formed in one or more of the surfaces of the pedestal 200, such as the end surface 234 or the side surfaces 236. In other aspects, the slots 240 may be formed in the upper wall surface 212 of the pedestal 200. The slots 240 also may be configured to correspond to the locations of the burner ports 124 of the burner 120, which may further improve flame production.

In other aspects, the slots 240 can be formed in the lower surface 232 (e.g., through the recessed surface 210) and/or the base 202 (e.g., through the lower wall surface 118) of the pedestal 200 to provide access to an additional volume of secondary air 80 from within the pedestal 200 or under the pedestal 200 and cooktop 114. The slots 240 are illustrated as rectangular openings for illustrative purposes only. One of ordinary skill will recognize that the slots 240 formed in the pedestal 200 may have various cross sectional shapes, depths, widths, spacings, and orientations with respect to each other and/or the direction of the fingers 204A-E of the pedestal 200. For example, the slots 240 can be square, curved, oval, circular, or V-groove shaped openings, or other shaped openings. Also, a plurality of holes in the surface or surfaces of the pedestal 200 can be provided in place of the slots 240. The holes can be circular, rectangular, square, or diamond shaped, as well as other suitable shapes.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A sealed gas burner for a household cooking appliance, the gas burner comprising:

a burner portion having a plurality of burner ports; and a pedestal portion under the burner portion for elevating the burner portion above a cooktop surface of the household cooking appliance, wherein the pedestal portion includes:

a base portion having a lower mounting; and an upper portion having an upper end that supports the burner, wherein the lower mounting surface is on an opposite side of the pedestal portion from the upper portion, wherein the base portion elevates the upper portion in a vertical direction above the cooktop surface, wherein an area of a footprint of the lower mounting surface is less than an area of a footprint of the upper end of the pedestal portion, wherein a periphery of the base portion increases continuously in a vertical direction from the lower mounting surface up to the upper portion and a periphery of the upper portion increases in a vertical direction from the base portion up to the upper portion in order to promote airflow of secondary air in the vertical direction along an outer surface of the periphery of the base portion and an outer surface of the periphery of the upper portion up to the plurality of burner ports of the burner portion, wherein the periphery of the base portion is less than the periphery of the upper portion, and wherein the base portion includes a first cavity extending upward through the base portion, and the first cavity facilitates a flow of an air-gas mixture through the base portion.

2. The gas burner according to claim 1, wherein a length of a perimeter of the lower mounting surface of the base portion is less than a length of a perimeter of the upper end of the upper portion.

3. The gas burner according to claim 1, wherein the lower mounting surface is in a first horizontal plane, wherein a vertical axis of the pedestal portion is substantially perpendicular to the first horizontal plane, wherein the first cavity extends through the base portion along the vertical axis of the pedestal portion, wherein the first cavity facilitates the flow of the air-gas mixture through the pedestal portion to the burner portion.

4. The gas burner according to claim 3, further comprising: a venturi tube, wherein the venturi tube is one of in fluid communication with the first cavity and disposed in the first cavity.

5. The gas burner according to claim 3, wherein the pedestal portion includes:

a second cavity that facilitates a flow of air through the base portion.

6. The gas burner according to claim 5, wherein the second cavity includes:

a first flow passage; and a second flow passage in fluid communication with the first flow passage, wherein the first flow passage extends through the pedestal portion in a direction substantially parallel to the vertical axis of the pedestal portion, and wherein the second flow passage extends through the upper portion in a direction substantially parallel to the first horizontal plane and toward a perimeter of the burner portion.

7. The gas burner according to claim 5, wherein an interior surface of the second cavity is one of tapered and curved with respect to the first horizontal plane.

8. The gas burner according to claim 5, wherein an interior surface of the second cavity is one of parallel to and perpendicular to the first horizontal plane.

9. The gas burner according to claim 5, wherein the upper portion of the pedestal has one of an opening and a slot that fluidly connects the second cavity to an exterior of the pedestal.

10. The gas burner according to claim 9, wherein the one of the opening and the slot of the upper portion is adjacent to a burner port of the plurality of burner ports of the burner portion.

11. The gas burner according to claim 1, wherein an exterior surface of the pedestal portion has one of a curved surface and a tapered surface that promotes a flow of air in a direction extending toward a burner port of the burner portion.

12. The gas burner according to claim 1, wherein the pedestal portion is integrally formed with the burner portion.

13. The gas burner according to claim 1, wherein the burner portion has a plurality of finger portions, and wherein the upper portion includes a plurality of finger portions corresponding to the plurality of finger portions of the burner portion.

14. The gas burner according to claim 13, wherein the base portion includes an ignitor mounting surface for receiving a burner ignitor, and wherein the ignitor mounting surface extends radially from the base portion and between two adjacent fingers of the plurality of finger portions of the upper portion.

15. The gas burner according to claim 1, wherein the base portion includes an ignitor mounting surface for receiving a burner ignitor.

16. A pedestal for supporting a gas burner of a household cooking appliance in an elevated position above a surface of a cooktop of the household appliance, the pedestal comprising:

a base portion, the base portion for vertically elevating an upper portion of the pedestal above the surface of the cooktop and having both a lower mounting surface configured to mount to the cooktop and a maximum perimeter of the footprint of the base portion that is smaller than a maximum perimeter of the footprint of the upper portion;

a burner body support surface at an upper-most end of the pedestal configured to support a burner body of the gas burner and to vertically elevate the burner body above the surface of the cooktop; and a first cavity extending entirely through the base portion and the upper portion from the lower mounting surface of the base portion to the upper-most end of the upper portion, wherein the first cavity facilitates a flow of an air-gas mixture through the base portion and the upper portion to the burner body of the gas burner.

17. The pedestal according to claim 16, wherein the lower mounting surface is in a first horizontal plane, and wherein a vertical axis of the base portion extends substantially perpendicular to the first horizontal plane.

18. The pedestal according to claim 17, wherein the first cavity is integrally formed with a venturi tube for facilitating the flow of the air-gas mixture from a mixing zone below the surface of the cooktop through the base portion and into the burner body of the gas burner.

19. The pedestal according to claim 17, further comprising:

a venturi tube for facilitating the flow of the air-gas mixture from a mixing zone below the surface of the cooktop through the base portion and the upper portion and into the gas burner, wherein the venturi tube is one of in fluid communication with the first cavity and disposed in the first cavity.

20. The pedestal according to claim 17, further comprising a second cavity extending through at least the base portion, the second cavity facilitating a flow of air through the base portion.

21. The pedestal according to claim 20, wherein the second cavity includes:

a first flow passage extending through the base portion in a direction substantially parallel to the vertical axis of the base portion; and a second flow passage in fluid communication with the first flow passage and extending through the upper portion in a direction toward the maximum perimeter of the upper portion.

22. The pedestal according to claim 20, wherein an interior surface of the second cavity is one of tapered and curved.

23. The pedestal according to claim 20, wherein an interior surface of the second cavity is one of parallel to and perpendicular to the first horizontal plane.

24. The pedestal according to claim 21, wherein the upper portion has one of an opening and a slot that fluidly connects the second cavity to an exterior of the pedestal.

25. The pedestal according to claim 24, wherein the one of the opening and the slot of the upper portion is arranged to be adjacent to a burner port of the burner body of the gas burner.

26. The pedestal according to claim 16, wherein an exterior surface of at least one of the base portion and the upper portion has one of a curved surface and a tapered surface that promotes a flow of air in a direction extending toward a burner port of the gas burner.

27. The pedestal according to claim 16, wherein the upper portion includes a plurality of finger portions configured to correspond to a plurality of finger portions of the burner body of the gas burner.

28. The pedestal according to claim 27, wherein the base portion includes an ignitor mounting surface for receiving a burner ignitor, and wherein the ignitor mounting surface extends radially from the base portion and between two adjacent fingers of the plurality of finger portions of the upper portion.

29. The pedestal according to claim 16, wherein the base portion includes an ignitor mounting surface for receiving a burner ignitor.

30. The pedestal of claim 16, wherein the lower mounting surface is configured to be mounted on a flat surface of a cooktop surface of the household cooking appliance.

31. The pedestal of claim 16, wherein the upper portion extends radially outward from the base portion, and wherein an exterior surface of the upper portion has one of a curved surface and a tapered surface configured to direct a flow of air over the exterior surface in a direction away from the base portion and toward the maximum perimeter of the upper portion.

32. The pedestal of claim 16, wherein the upper portion includes a plurality of sections that extend radially outward from the base portion, and wherein an exterior surface of the upper portion has one of a curved surface and a tapered surface configured to direct a flow of air over the exterior surface in a direction away from the base portion and toward a perimeter of each of the plurality of sections of the upper portion.

33. The pedestal of claim 31, further comprising:

a second cavity configured to facilitate a separate flow of air through the base portion and the upper portion and to direct the separate flow of air in a direction toward the maximum perimeter of the upper portion, wherein the upper portion has one of an opening and a slot configured to fluidly connect the second cavity to an exterior of the upper portion.

34. The pedestal of claim 32, further comprising:

a second cavity configured to facilitate a separate flow of air through the base portion and the upper portion to direct the separate flow of air in a direction toward the perimeter of each of the plurality of sections of the upper portion, and wherein each of the plurality of parts of the upper portion has one of an opening and a slot configured to fluidly connect the second cavity to an exterior of the upper portion.

35. The pedestal of claim 16, wherein the upper-most end has a planar surface and the lower mounting surface has a planar surface, and wherein the planar surface of the upper-most end is parallel to the planar surface of the lower mounting surface.

36. The pedestal according to claim 16, wherein an exterior surface of the base portion has one of a curved surface and a tapered surface that promotes a flow of air in a direction extending from a perimeter of the lower mounting surface toward the upper portion.

37. The pedestal of claim 16, wherein a shape of the maximum perimeter of the upper-most end is a star configuration.

38. The pedestal of claim 16, wherein the lower mounting surface of the base portion is configured to be coupled directly to the surface of the cooktop of the household appliance.

39. The pedestal of claim 16, wherein the lower mounting surface of the base portion is configured to be coupled indirectly to the surface of the cooktop of the household appliance.

40. The pedestal of claim 16, wherein the lower mounting surface of the base portion is configured to be coupled to another part on the surface of the cooktop of the household appliance.

41. The pedestal of claim 16, wherein the lower mounting surface of the base portion is integrally formed with another part on the surface of the cooktop of the household appliance.

42. The pedestal of claim 16, wherein the lower mounting surface of the base portion is configured to be sealed to the surface of the cooktop of the household appliance.

43. The pedestal of claim 16, wherein the lower mounting surface of the base portion is configured to be sealed to another part on the surface of the cooktop of the household appliance.

44. The pedestal of claim 16, wherein the upper portion is integrally formed with the burner body of the gas burner.

45. The pedestal of claim 16, wherein the upper portion has a continuous outer surface being continuously tapered to promote an airflow of secondary air to the maximum perimeter of the upper portion.

46. The pedestal of claim 16, further comprising:

a second cavity extending through the base portion and at least a portion of the upper portion, the second cavity configured to facilitate a separate flow of air through the base portion and into the upper portion, wherein the upper portion includes one of an opening and a slot that fluidly connects the second cavity to an exterior of the upper portion such that the separate—flow of air can exit the second cavity to an exterior of the upper portion.

47. The pedestal of claim 46, wherein the second cavity includes an interior surface having one of a curved surface and a tapered surface configured to direct the separate flow of air in a direction toward the one of the opening and the slot of the upper portion.

48. The pedestal of claim 16, wherein the upper portion includes an exterior sidewall surface, an exterior underside surface, and the burner body support surface extending around a perimeter of an upper end of the exterior sidewall surface, the burner body support surface configured to support an exterior sidewall surface of the burner body above the exterior sidewall surface of the upper portion.

49. The pedestal of claim 48, wherein the base portion includes an exterior sidewall surface interposing the exterior underside surface of the upper portion and the lower mounting surface of the base portion to provide a vertical clearance between the exterior underside surface of the upper portion and the lower mounting surface of the base portion.

50. The pedestal of claim 16, further comprising a second cavity independent of the first cavity, the second cavity extending entirely through the base portion and the upper portion from the lower mounting surface of the base portion to the upper-most end of the upper portion.

51. The pedestal of claim 16, wherein a perimeter of an exterior sidewall surface of the base portion increases continuously in a vertical direction from the lower mounting surface up to an intersection of the base portion with the upper portion.

52. The pedestal of claim 16, wherein a perimeter of an exterior sidewall surface of the upper portion increases continuously in a vertical direction from an intersection of the base portion with the upper portion to the upper-most end of the upper portion.

53. The pedestal of claim 48, wherein the upper portion includes a plurality of slots formed in the burner body support surface of the upper-most end of the upper portion and partially in the exterior sidewall surface of the upper-most end of the upper portion.

54. The pedestal of claim 16, wherein the maximum perimeter of the upper portion is a length of a perimeter of the upper-most end of the pedestal.

55. The pedestal of claim 16, wherein the maximum perimeter of the base portion is a length of a perimeter of the base portion at a location where the base portion intersects with the upper portion.

56. The pedestal of claim 16, wherein the maximum perimeter of the footprint of the base portion is smaller than a maximum perimeter of the footprint of the upper-most end of the pedestal.

57. The pedestal of claim 16, wherein the maximum perimeter of the footprint of the base portion is smaller than a maximum perimeter of the burner body support surface.

58. A pedestal for supporting a gas burner of a household cooking appliance in an elevated position above a surface of a cooktop of the household appliance, the pedestal comprising:

a base portion, the base portion for vertically elevating an upper portion of the pedestal above the surface of the cooktop and having a lower mounting surface configured to mount to the cooktop; and a burner body support surface at an upper-most end of the pedestal configured to support a burner body of the gas burner and to vertically elevate the burner body above the surface of the cooktop, wherein a part of the upper portion extends beyond a footprint of the base portion and a part of the base portion extends beyond a footprint of the upper portion.

59. The pedestal of claim 58, wherein the part of the base portion includes an ignitor mounting surface for receiving a burner ignitor.

60. The pedestal of claim 58, wherein the part of the upper portion that includes a plurality of finger portions corresponds to a plurality of finger portions of the burner body of the gas burner.

61. The pedestal of claim 60, wherein the part of the base portion includes an ignitor mounting surface for receiving a burner ignitor, the part of the base portion extending between two adjacent finger portions of the plurality of finger portions of the upper portion.

62. The pedestal of claim 58, wherein the part of the upper portion includes an exterior sidewall surface, an exterior underside surface, and the burner body support surface configured to support an exterior sidewall surface of the burner body above the exterior sidewall surface of the part of the upper portion, and wherein the part of the base portion includes an exterior sidewall surface, an exterior upper surface, and at least a portion of the lower mounting surface extending beyond the footprint of the upper portion.

63. A household cooking appliance comprising:

a cooktop surface having an opening;

a sealed gas burner over the opening of the cooktop surface; and a pedestal interposing the cooktop surface and the sealed gas burner for elevating the gas burner above the cooktop surface;

wherein the pedestal includes:

a base portion having a lower mounting surface; and an upper portion having an upper end-supporting the sealed gas burner, wherein the base portion elevates the upper portion in a vertical direction above the cooktop surface, wherein the lower mounting surface is on an opposite side of the base portion from the upper portion, wherein an area of a footprint of the lower mounting surface is less than an area of a footprint of the upper end of the pedestal, wherein a periphery of the base portion increases continuously in a vertical direction from the lower mounting surface up to the upper portion and a periphery of the upper portion increases in a vertical direction from the base portion up to the upper portion in order to promote airflow of secondary air in the vertical direction along an outer surface of the periphery of the base portion and an outer surface of the periphery of the upper portion up to ports of the sealed gas burner, wherein the periphery of the base portion is less than the periphery of the upper portion, and wherein the base portion includes a first cavity extending upward through the base portion, and the first cavity facilitates a flow of an air-gas mixture through the base portion.

* * * * *